United States Patent [19]

Grandmaire et al.

[11] Patent Number: 4,661,270

[45] Date of Patent: Apr. 28, 1987

[54] CONCENTRATED FABRIC SOFTENING COMPOSITION AND METHODS FOR MAKING SAME

[75] Inventors: Jean-Paul Grandmaire, Andrimont; Alain Jacques, Blegny, both of Belgium

[73] Assignee: Colgate-Palmolive Company, New York, N.Y.

[21] Appl. No.: 728,447

[22] Filed: May 1, 1985

Related U.S. Application Data

[63] Continuation of Ser. No. 493,450, May 11, 1983, abandoned.

[51] Int. Cl.[4] ..... D06M 13/30; D06M 13/36; D06M 13/38

[52] U.S. Cl. ..... 252/8.75; 252/8.8; 252/545; 252/547

[58] Field of Search ..... 252/8.75, 8.8, 528, 252/547, 545

[56] References Cited

U.S. PATENT DOCUMENTS

| | | | |
|---|---|---|---|
| 3,349,033 | 10/1967 | Zuccarelli | 252/8.75 |
| 3,644,203 | 2/1972 | Lamberti et al. | 252/8.75 |
| 3,681,241 | 8/1972 | Rudy | 252/8.75 |
| 3,904,533 | 9/1975 | Neiditch et al. | 252/8.8 |
| 3,920,565 | 11/1975 | Morton | 252/8.75 |
| 3,946,115 | 3/1976 | Brever et al. | 426/72 |
| 3,974,076 | 8/1976 | Wiersema et al. | 252/8.8 |
| 3,997,453 | 12/1976 | Wixon | 252/8.75 |
| 4,038,196 | 7/1977 | Minegishi | 252/8.8 |
| 4,073,735 | 2/1978 | Ramachandran | 252/8.8 |
| 4,076,632 | 2/1978 | Davis | 252/8.8 |
| 4,118,327 | 10/1978 | Seugnet | 252/8.8 |
| 4,119,545 | 10/1978 | Chazard | 252/8.8 |
| 4,124,517 | 11/1978 | Hisamoto | 8/142 |
| 4,157,307 | 6/1979 | Jaeger | 252/8.75 |
| 4,199,545 | 4/1980 | Matovich | 422/112 |
| 4,233,164 | 11/1980 | Davis | 252/8.8 |

FOREIGN PATENT DOCUMENTS

| | | |
|---|---|---|
| 2053249 | 5/1980 | United Kingdom . |

*Primary Examiner*—Dennis L. Albrecht

*Attorney, Agent, or Firm*—Herbert S. Sylvester; Murray M. Grill; Norman Blumenkopf

[57] ABSTRACT

Stable concentrated aqueous fabric softening compositions based on water-dispersible di-longchain, di-short chain quaternary ammonium salts are provided utilizing ethoxylated amine salts and water-soluble electrolyte. The softening quaternary component comprises from about 12–20% by weight of the composition; the amine salt from about 0.5 to about 10% preferably about 1 to 7% by weight and the electrolyte from about 0.1 to 1.5% by weight. Ratios of quaternary compound to amine salt may vary from about 40:1 to 2:1 and preferably from about 10:1 to 5:1. Methods for making the composition are also described.

23 Claims, No Drawings

CONCENTRATED FABRIC SOFTENING COMPOSITION AND METHODS FOR MAKING SAME

This application is a continuation of application Ser. No. 493,450, filed 5/11/83, now abandoned.

BACKGROUND OF THE INVENTION

The present invention relates to fabric softener compositions adapted for the use in the rinse cycle of a laundering process and in particular to concentrated aqueous fabric softener compositions which are stable at both low and high ambient temperatures, i.e. such compositions do not form a gel, and which are easily dispersed in water when used.

Compositions containing quaternary ammonium salts having at least one long chain hydrocarbyl group are commonly used to provide fabric softening benefits when employed in a laundry rinse operation; for example, see U.S. Pat. Nos. 3,349,033; 3,644,203; 3,946,115; 3,997,453; 4,073,735 and 4,119,545.

For most aqueous softener compositions containing cationic quaternary ammonium compounds as active ingredients, the concentration of such cationics has, in general, been limited to the range of about 3 to 6% by weight (see U.S. Pat. Nos. 3,904,533 and 3,920,565). Such a low concentration is generally necessitated by the fact that cationics form gels in water systems at concentrations at above about 8%, and while the use of electrolytes to lower the viscosity of such compositions is know (see in particular U.S. Pat. No. 4,199,545), such electrolytes are far from satisfactory. From a functional point of view, the electrolytes often do not perform as required particularly at concentrations of the cationics in the neighborhood of about 12–15%. Further, while the performance of the electrolytes may mitigate some of the gelling problem, their use is far from satisfactory in providing a highly concentrated aqueous system of cationics which does not gel or severely change in viscosity within the usual range of temperatures encountered in the handling thereof, for example 0° F. (about −18° C.) up to about 140° F. (about 60° C.). In U.S. Pat. No. 3,681,241 a concentrated fabric softening emulsion is described which consists essentially of 3.5 to 6.5 parts by weight of a compound represented, for example, by distearyl dimethyl ammonium chloride, from 3.5 to 6.5 parts by weight of an alkyl amido imidazolinium alkylsulfate, and from 0 to 3 parts by weight of a different but similar fatty amido imidazolinium alkylsulfate, the latter allegedly providing low temperature stability for the composition. The total actives contemplated range from about 8 to 13%.

In British application 2053249A published Feb. 4, 1981, there are disclosed cationic fabric softening compositions containing 15 to 60% by weight of cationic softener, 25 to 75% by weight of an aqueous medium, and 0.5 to 40% by weight of a specified water soluble polymer.

In U.S. Pat. No. 3,974,076 there are disclosed quaternary ammonium-containing softening composition of conventional cationic concentrations, i.e. about 3% to about 6%. These compositions are characterized by the very small particle size of the substantially water-insoluble quaternary ammonium softening compound, i.e. 90% by weight of the quaternary ammonium compounds exist as particles which will pass through a 1.2 micron filter. The compositions are described as a combination of the cationic softener, a $C_8$ to $C_{20}$ alkyl alcohol with from about 0.1% to about 2.0% of a non-ionic surfactant having a HLB of from about 8 to about 15, and preferably from about 10 to about 14. The preferred non-ionics have a lipophilic hydrocarbyl moiety equivalent of 9 to 15 carbon atoms with 7 to 13 ethylene oxide hydrophilic moieties. This patent does not relate to the problem of stability of concentrated aqueous cationic softening compositions but rather to improving the level and uniformity of softening using conventional concentrations.

Each of U.S. Pat. Nos. 4,076,632; 4,157,307 and 4,233,164 discloses quaternary ammonium softening containing inter olia, "protonated" ethoxylated amine, but none of these disclose salts of the amine, let alone with high molecular weight organic acids (i.e. higher fatty acids e.g. $C_{12}$ to $C_{30}$; alkyl aryl sulfonic acids e.g. $C_{12}$ to $C_{18}$ alkyl benzene sulfonic acids; $C_{12}$ to $C_{30}$ paraffin (alkyl) sulfonic acids; $C_{12}$ to $C_{30}$ olefin sulfonic acids; the mono- & di-phosphoric acid esters of $C_8$ to $C_{30}$ alcohols including the ethoxylates of such alcohols with from one to 100 moles of ethylene oxide). U.S. Pat. No. 4,118,327 describes conventional cationic concentration (0.1 to 10% preferably 1 to 8% by weight) with phosphate organoesters as anti-static agents.

SUMMARY OF THE INVENTION

The present invention provides low and high temperature stable, concentrated, aqueous softener compositions based upon quaternary ammonium softening compounds and a minor amount of an amine salt of an ethoxylated long chain amine with a long chain organic acid and electrolyte. Water-soluble polymers such as polyethyleneglycol (e.g. M.W. 400) are a preferred optional ingredient.

DETAILED DESCRIPTION OF THE INVENTION

The composition of the present invention are stable aqueous compositions which contain a high concentration of the cationic fabric softener which is a water dispersible quaternary ammonium compounds as hereinafter described, and an amine salt, also as hereinafter described.

The aqueous compositions of this invention contain at least about 12% cationic softener up to about 20% thereof, said cationic softener having the general formula I

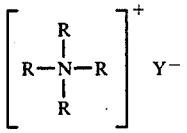

wherein the R groups are selected from $C_1$ to $C_{30}$ aliphatic, preferably alkyl or alkenyl, aryl (e.g. phenyl, tolyl, cumyl, etc.); aralkyl (e.g. benzyl, phenethyl, etc.); and the halo, amide, hydroxyl, and carboxy substituents thereof; with the proviso that at least one R is $C_{14}$ to $C_{30}$ and preferably $C_{14}$ to $C_{18}$, and the others are lower alkyl, and more preferably at least two R's are $C_{14}$ to $C_{18}$ and the others are lower alkyl of $C_1$ to $C_4$ (and most preferably methyl or ethyl), and Y is a water-solubilizing anion such as chloride, bromide, iodide, fluoride, sulfate, methosulfate, nitrite, nitrate, phosphate and carboxylate (i.e. acetate, adipate, propionate, phthalate, benzoate, oleate, etc.). Typical cationics of formula I include the following:

distearyl dimethyl ammonium chloride
ditallow dimethyl ammonium chloride
dihexadecyl dimethyl ammonium chloride
distearyl dimethyl ammonium bromide
di(hydrogenated tallow) dimethyl ammonium bromide
distearyl, di(isopropyl) ammonium chloride
distearyl dimethyl ammonium methosulfate The amine salts contemplated herein are based upon ethoxylated long chain amines and long-chain organic acids. The amines are typically $C_{12}$ to $C_{30}$ aliphatic amines, and preferably $C_{12}$ to $C_{20}$ amines and admixtures thereof reacted with from one to about 100 moles of ethylene oxide. The amines may also be reacted with propylene or butylene oxide and then with ethylene oxide. The final oxyalkylated amine should be a water-soluble product. Of particular value are the amines derived from natural fatty acids such as the Armeens and Ethomeens and these generally comprise a mixed alkyl ranging from $C_{10}$ to $C_{18}$, or $C_{12}$ to $C_{16}$, or $C_{12}$ to $C_{15}$, or $C_{16}$ to $C_{18}$ and the like. Preferred ethoxylated amines are those containing from about 5 to about 50 moles of condensed ethylene oxides and more preferred are ethoxylated amines with about 10 to about 35 moles condensed ethylene oxide. Most preferred contain 12 to 20 moles of ethylene oxide. A suitable ethoxylated alkyl amine is Ethomeen T25 which is represented by the formula

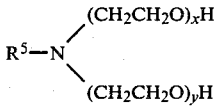

$$R^5-N\begin{matrix}(CH_2CH_2O)_xH\\(CH_2CH_2O)_yH\end{matrix}$$

wherein $R^5$ is $C_{16}$–$C_{18}$ alkyl and $x+y=15$.

The third ingredient is an electrolyte (ionic) material in an amount of from about 0.5 to 5 percent, e.g. about 0.1 to about 1.5% by weight. The use of an electrolyte acts not only to control viscosity but also assists in stabilizing the system agains gelling & phase inversion at high temperatures, e.g. about about 40° C. Suitable electrolytes include water soluble alkali metal, alkaline earth metal or ammonium chloride, bromide, nitrite, nitrate, formate or acetate salts. Particularly suitable electrolytes include sodium chloride and calcium chloride. Other useful electrolytes include sodium formate, sodium nitrite, sodium nitrate, sodium acetate among others as well as water-soluble salts of other cations such as potassium, lithium, magnesium, ammonium and the like.

Minor amounts of lower alkanols may be used particularly where it is desired to further modify the viscosity. In general, alcohols tend to lower the viscosity at ambient temperatures, although moderate amounts may effect a lowering of the phase inversion temperature. The preferred compositions of this invention exhibit phase inversion temperatures above about 80° C. and preferably above about 90° C. with amounts of alcohol in the range of about 1 to about 10% by weight. Particularly suitable alcohols are ethyl and isopropyl alcohol.

In addition to the foregoing components of the softening compositions of this invention, there may also be included numerous conventional, supplemental, and optional ingredients which do not adversely affect the stability and/or functional characteristics of the instant compositions. Thus, for example, there may be present the ubiquitous perfumes, dyes, pigments, opacifiers, germicides, optical brighteners, anti-corrosion agents (e.g. sodium silicate) water-soluble polymers, anti-static agents and the like. Where used, each may comprise from 0.01% to about 5% by weight of the composition.

It is, of course, recognized and understood that most available chemical materials and particularly those containing an hydrocarbyl moiety are generally mixtures of closely related moieties. Thus, the long chain alkyl substituents (R) in the cationics used in this invention may not only be a single carbon length chain but more probably a mixture. In this regard a particularly useful quaternary set wherein the alkyl groups are derived from tallow may contain about 35% $C_{16}$ and 60% $C_{18}$ and minor amounts of $C_{14}$ and even others.

The fabric softening compositions of this invention must have in addition to viscosity and phase stability, the requisite viscosity (i.e. for pourability) and water-dispersibility in the rinse cycle (or any other form of dilution prior to use) which the consumers have come to accept and demand from their use of the less concentrated products. Thus the products contemplated herein may have viscosities ranging from about 30 cps to about 250 cps and preferably from about 40 cps to about 120 cps.

In addition to affording excellent dispersibility characteristics in water, the amine salts used therein contributes softening as well so that, for example, a concentrate of 12% quaternary compound and 2% amine salt is not merely equivalent to 2X a conventional 6% cationic composition but is almost 2:5 times as effective.

The general procedures for preparing the composition herein are several in number, the final product varying somewhat in stability. The selected procedure depend on the components used & differ in the order of material addition and the processing conditions.

A typically preferred procedure (A) involves adding the non-ionic material and coloring, if any, to the formula weight of water which is at about 70° C. To this solution there is slowly added the cationic softener in "melted" form (50°–60° C.) to which the amine salt has already been added. Usually a gel will form. The mixture is cooled to about 40° C. and then the electrolyte is added to break the gel. The composition is then cooled to room temperature with stirring. A modification of procedure (A) involves adjusting the pH to about 12 before adding the melted cationic. In this case no gel forms. After cooling to about 40° C., the pH is readjusted to 5 to 6, cooled with stirring to room temperature and then electrolyte is used to adjust the viscosity (Procedure B). Still another procedure (C) involves adding the non-ionic and electrolyte to at least 80% of warm water (about 40° C.), and then the cationic softener and amine salt as in procedure (A). Generally, no gel will form. The rest, if any, of the water is then added, and the composition is then cooled with agitation to room temperature.

The following examples will serve to illustrate the present invention without being deemed limitative thereof. Parts are by weight unless otherwise indicated.

EXAMPLE 1

Following Procedure (A) described above, 1 part of polyethylene glycol (MW. 400) & 1.2 parts of 0.2% color solution are dissolved in about 70 parts of water at a temperature of about 70° C. To this solution are slowly added 17.6 parts of distearyl dimethyl ammonium chloride (75% active and containing about 10% isopropanol and the balance water) is melted form to which has been previously added 3.7 parts Ethomeen T25* and 1.3 parts of dodecyl benzene sulfonic acid (Temperature=55° C.) with stirring. A gel is formed. The gel is cooled down to about 40° C. and then 0.5 parts of calcium chloride dihydrate are added. The mixture is cooled to room temperature (about 20° C.) with stirring. A stable product results with a viscosity of about 100 cps.

*Tallow amine (40% $C_{16}$; 60% $C_{18}$) condensed with 15 moles of ethylene oxide.

EXAMPLE 2

The procedure of Example 1 is repeated utilizing the following parts of (A) cationic (active), (B) amine, (C) sulfonic acid and (D) electrolyte.

(a) A=12; B=1.0; C=0.32; D=0.5
(b) A=14; B=1.5; C=0.52; D=0.5
(c) A=16; B=1.8; C=0.63; D=0.7
(d) A=18; B=2.5; C=0.88; D=1.0

EXAMPLE 3

Example 1 and 2 are repeated utilizing in place of distearyl dimethyl ammonium chloride the following:

(a) ditallow dimethyl ammonium chloride
(b) distearyl dimethyl ammonium methosulfate
(c) di(hydrogenate tallow) dimethyl ammonium bromide
(d) di-hexadecyl dimethyl ammonium chloride
(e) distearyl diethyl ammonium chloride

EXAMPLE 4

Examples 1, 2 and 3 are repeated adding in all instances 1 part of polyethylene glycol (MW 400) with the amine salt in the first step of the process of the preparation.

Polyethylene glycol (MW 400) is illustrative of low molecular weight, water-soluble polymers which may be used if desired in the softening compositions of this invention. Among other useful polymers reference is made to British published application 2053249A described above which is hereby incorporated herein by such reference thereto. The compositions of this invention may include any and all of such polymers and other water-soluble polymers as well. In the compositions of this invention one may use from 0.1% to 20% by weight of the total composition of these materials.

EXAMPLE 5

Each of the foregoing examples 1 to 4 is repeated using as the electrolyte the following:

(a) sodium chloride
(b) sodium nitrate
(c) sodium formate
(d) ammonium bromide
(e) potassium chloride
(f) calcium nitrate
(g) lithium acetate
(h) magnesium chloride

EXAMPLE 6

Each of Examples 1 to 5 is repeated, composition-wise, but following the Procedure (B) for making the compositions. In this procedure the change in the processing described in Example 1 involves adjusting the pH to 12 with sodium hydroxide after dissolution of the amine salt (and polyethylene glycol where used), and readjusting the pH to 5–6 with hydrochloric acid after the addition of the cationic. At this point no gel forms as in Procedure (A). The electrolyte is added after the moisture has been cooled to room temperature.

EXAMPLE 7

Each of Examples 1 to 5 is repeated again, compositions-wise but following Procedure (C) to prepare the compositions.

In this procedure the amine salt (and the water soluble polyethylene glycol where used) is dissolved in 80% of the formula weight of water at a temperature of 35°–40° C. The electrolyte is then added, followed by the melted cationic. The remaining formula weight of water is then added and thereafter the mixture is cooled to room temperature with stirring.

EXAMPLE 8

Following procedure (A) described above, 1 part of polyethylene glycol (M.W. 400) and 1.2 parts of 0.2% color solution are dissolved in about 70 parts of water at a temperature of about 70° C.

To this solution are slowly added 17.6 parts of ditallow dimethyl ammonium chloride (75% active and containing about 10% isopropanol and the balance water) in melted form to which has previously added 2 parts Ethomeen T25 (tallow amine-40% $C_{16}$, 60% $C_{18}$) condensed with 15 moles of ethylene oxide) and 0.62 of stearic acid (temperature=55° C.) with stirring. A stable product results with a viscosity of about 100 cps.

EXAMPLE 9

Example 8 is repeated utilizing the parts of cationic, amine and the electrolytes of Example 2 and at the same time varying the stearic acid so that it is stoichiometric to the amount of amine.

EXAMPLE 10

Example 9 is repeated by replacing stearic acid with stoichiometric amount of following acids: lauric, cis-9 dodecenioc, myristic, cis-9 tetradecenoic, pentadecanioc, cis-9 pentadecenioc, palmitic, cis-9 hexadecenioc, heptadecanoic, cis-9 heptadecenoic, oleic, linoleic, linolenic, -eleostearic, 4 oxo cis-9 trans 11, trans 13 octadecatrienoic, ricinoleic, dihydroxystearic, nonadecanoic, eicosanoic, cis-11 eicosenoic, cis-9 eicosenoic, eicosadienoic, eicosatrienoic, arachidonic, eicosapentaenoic, docosanoic, cis-13 docosenoic, docosadienoic, docosatetraenoic, 4.8.12.15.19 docosapentaenoic, docosahexanoic, tetracosanoic, tetracosenoic, 4.8.12.15.18.21 tetracosahexaenoic and mixtures there of.

EXAMPLE 11

Example 9 and 10 are each repeated replacing on one hand the quat with those of Example 3 and additionally repeating all of these examples utilizing in the composition 1 part of polyethylene glycol (MW 400).

The aqueous softening composition of this invention are generally applicable as other such compositions, particularly useful in the rinse cycle of an automatic laundry machine. In such operations as well as in any other desired method of treating clothes, the compositions are usually employed to provide generally an active concentration of from about 0.005% to 0.3% based on the weight of clothes treated preferably 0.007% to about 0.2% and most preferable from about 0.01% to about 0.15%.

We claim:

1. A stable, aqueous, concentrated fabric softening composition comprising about (A) 12 to 20% by weight of a cationic softener of the formula:

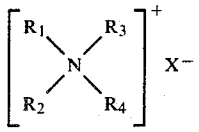

wherein $R_1$, $R_2$, $R_3$ and $R_4$ are aliphatic radicals of $C_1$ to $C_{30}$ with at least one being alkyl of $C_{14}$ to $C_{30}$; (B) 1 to 5% by weight of an amine salt of an ethoxylated alkyl amine and at least one of an $C_{12}$ to $C_{18}$ alkyl aryl sulfonic acid, $C_{12}$ to $C_{30}$ alkyl sulfonic acid, $C_{12}$ to $C_{30}$ olefin sulfonic acid or a $C_{12}$ to $C_{30}$ alkyl or olefin fatty acid, and (C) 0.5 to about 5% by weight of a water soluble metal or ammonium salt viscosity control electrolyte.

2. A composition as defined in claim 1 wherein A is distearyl dimethyl ammonium chloride.

3. A composition as defined in claim 2 wherein compound (B) is the amine salt of an ethoxylated alkyl amine containing an average of about 15 moles of ethylene oxide and an alkyl or olefin fatty acid.

4. A composition as defined in claim 1 wherein the ratio of (A) to (B) is about 40:1 to 2:1.

5. A composition as defined in claim 4 wherein the amount of compound (A) is about 12% and that of (B) is about 2%.

6. A composition as defined in claim 1 wherein the compound (A) softener concentration is about 12 to 15% by weight.

7. A method for preparing a composition as defined in claim 1 which comprises first preparing an aqueous solution of the compound (B) amine salt in warm water at a temperature up to about 80° C. thereafter adding the compound (A) cationic softener in melted form to form a gel, cooling said gel to below 40° C., and then adding the compound (C) electrolyte to break the gel.

8. A method as defined in claim 7 wherein the warm water temperature is about 70° C., the gel is cooled to just below 40° C. and after the gel is broken the mixture is cooled to room temperature with stirring.

9. A method for preparing a composition as defined in claim 1 which comprises first preparing an aqueous solution of the compound (B) amine salt in warm water at a temperature of up to about 80° C., adjusting the pH with an alkaline compound to above about 10, adding the compound (A) cationic softener in melted form, readjusting the pH to below 7, cooling to about room temperature and then adding the compound (C) water soluble metal salt electrolyte to adjust the viscosity.

10. A method for preparing a composition as defined in claim 1 which comprises first preparing an aqueous solution of the compound (B) amine salt then adding the compound (C) water soluble metal salt electrolyte followed by the compound (A) cationic softener in melted form and cooling to room temperature.

11. A stable, aqueous, concentrated fabric softening composition comprising (A) about 12 to 20% by weight a quaternary ammonium cationic softener of the formula:

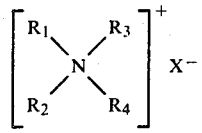

wherein $R_1$, $R_2$, $R_3$ and $R_4$ are aliphatic radicals of $C_1$ to $C_{30}$ with one or two being $C_{14}$ to $C_{30}$ alkyl and the others being $C_1$ to $C_4$ alkyl and X is a water solubilizing anion; (B) about 1.0 to 5% by weight of an amine salt of an ethoxylated alkyl amine of the formula:

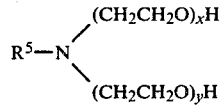

wherein $R^5$ is $C_{12}$ to $C_{30}$ alkyl and $x+y=10$ to 35, and $C_{12}$ to $C_{30}$ alkyl fatty acid, $C_{12}$ to $C_{30}$ olefin fatty acid, $C_{12}$ to $C_{18}$ alkyl benzene sulfonic acid, $C_{12}$ to $C_{30}$ alkyl sulfonic acid, or $C_{12}$ to $C_{30}$ olefin sulfonic acid; and (C) about 0.1 to 1.5% by weight of a water soluble alkali metal, alkaline earth metal, or ammonium chloride, bromide, nitrite, nitrate, formate, or acetate salt electrolyte.

12. The fabric softening composition of claim 11 wherein in the compound (A) quaternary ammonium cationic softener one of $R_1$ to $R_4$ is $C_{14}$ to $C_{18}$ alkyl and the others are methyl or ethyl.

13. The fabric softening composition of claim 12 wherein in the compound (A) quaternary ammonium cationic softener two of $R_1$ to $R_4$ is $C_{14}$ to $C_{18}$ alkyl and the others are methyl or ethyl.

14. The fabric softeing composition of claim 11 wherein in the compound (A) quaternary ammonium cationic softener is at least one of distearyl dimethyl ammonium chloride,
ditallow dimethyl ammonium chloride,
dihexadecyl dimethyl ammonium chloride,
distearyl dimethyl ammonium bromide,
di(hydrogenated tallow) dimethyl ammonium bromide,
distearyl, di(isopropyl) ammonium chloride,
disteaaryl dimethyl ammonium methosulfate, and
distearyl diethyl ammonium chloride.

15. The fabric softening composition of claim 11 wherein the compound (B) is an amine salt of an ethoxylated alkyl amine wherein $R^5$ is $C_{12}$ to $C_{20}$ alkyl and $x+y$ is 12 to 20, and at least one of the fatty acids lauric, dodecanoic, myristic, tetradecanoic, pentadecanoic, palmitic, hexadecanoic, heptadecanoic, oleic, linoleic, linolenic, stearic, octadecatrienoic, ricinoleic, dihydroxy stearic, nonadecanoic, eicosanoic, eicosadienoic, eicosatrienoic, arachidonic, eisocapentaenoic, docosanoic, docosadienoic, docosatetranoic, docosapentanoic, docosahexanoic, tetracosanoic, tetracosenoic, tetracosahexaenoic and mixtures thereof.

16. The fabric softening composition of claim 11 wherein the compound (B) is an amine salt of an ethoxylated alkykl amine wherein $R^5$ is $C_{12}$ to $C_{20}$ alkyl and $x+y$ is 12 to 20, and at least one dodecyl benzene sulfonic acid and stearic acid.

17. The fabric softening composition of claim 11 wherein the compound (C) water soluble metal salt electrolyte is at least one of sodium chloride, sodium nitrate, sodium nitrate, sodium formate, ammonium bromide, potassium chloride, lithium acetate, calcium chloride, calcium nitrate, and magnesium chloride.

18. The fabric softening composition of claim 17 wherein the compound (C) water soluble metal salt electrode is in an amount of 0.1 to 1.5% by weight and is at least one of sodium chloride and calcium chloride.

19. The fabric softening composition of claim 16 comprising a compound (C) water soluble metal salt electrolyte sealed from sodium chloride, sodium nitrate, sodium nitrate, sodium formate, ammonium bromide, potassium chloride, lithium acetate, calcium chloride, calcium nitrate and magnesium chloride.

20. The fabric softening composition of claim 19 wherein the compound (C) water soluble metal salt electrolyte is in an amount of 0.1 to 1.5% by weight and is at least one of sodium chloride and calcium chloride.

21. The fabric softening composition of claim 11 wherein the ratio of compound (A) to compound (B) is 40:1 to 2:1.

22. The fabric softening composition of claim 11 wherein the compound (A) is in an amount of about 12 to 15% by weight.

23. The fabric softening composition of claim 11 wherein the compound (A) is in an amount of about 12% by weight and the compound (B) is in an amount of about 2% by weight.

* * * * *